US007992756B2

(12) United States Patent
Franz et al.

(10) Patent No.: US 7,992,756 B2
(45) Date of Patent: Aug. 9, 2011

(54) HAND-HELD FASTENER DRIVER

(75) Inventors: Karl Franz, Feldkirch (AT); Robert Spasov, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 192 days.

(21) Appl. No.: 12/586,757

(22) Filed: Sep. 28, 2009

(65) Prior Publication Data

US 2010/0089963 A1 Apr. 15, 2010

(30) Foreign Application Priority Data

Oct. 9, 2008 (DE) ..... 10 2008 042 699

(51) Int. Cl.
*B25C 1/06* (2006.01)

(52) U.S. Cl. ..... 227/132; 227/131; 227/134

(58) Field of Classification Search ..... 227/131, 227/132, 134, 146; 173/117, 120, 121, 124, 173/202, 205
See application file for complete search history.

(56) References Cited

U.S. PATENT DOCUMENTS

| | | | | | |
|---|---|---|---|---|---|
| 3,810,572 | A * | 5/1974 | Malkin | 227/132 |
| 3,924,692 | A * | 12/1975 | Saari | 173/117 |
| RE29,354 | E * | 8/1977 | Malkin | 227/132 |
| 5,261,384 | A * | 11/1993 | Hu | 124/66 |
| 5,794,325 | A * | 8/1998 | Fallandy | 29/566.4 |
| 7,520,414 | B2 * | 4/2009 | Blessing et al. | 227/131 |
| 7,537,146 | B2 * | 5/2009 | Schiestl | 227/133 |
| 7,757,922 | B2 * | 7/2010 | Wang | 227/132 |
| 7,922,059 | B2 * | 4/2011 | Schiestl et al. | 227/132 |
| 7,938,305 | B2 * | 5/2011 | Simonelli et al. | 227/132 |
| 2008/0296339 | A1 | 12/2008 | Fielitz et al. | 227/107 |

FOREIGN PATENT DOCUMENTS

| | | |
|---|---|---|
| DE | 32 37 087 | 4/1984 |
| DE | 10 2007 000 226 | 10/2008 |
| EP | 1 935 572 | 6/2008 |

* cited by examiner

*Primary Examiner* — Stephen F Gerrity
*Assistant Examiner* — Andrew M Tecco
(74) *Attorney, Agent, or Firm* — Davidson, Davidson & Kappel, LLC

(57) ABSTRACT

A hand-held fastener driver for fastening elements, having a driving tappet that is movably mounted in a tappet guide and that can be driven using at least one drive spring element is disclosed, having a tensioner for the drive spring element, and having a locking mechanism. In a locked position of the locking mechanism, the drive spring element can be locked in its tensioned position, whereby the tensioner has a tensioning element that is provided with a profile, and said tensioning element can be axially moved along a longitudinal axis of motion using a rotatable counter-element that is engaged with the profile and that can be driven by a motor.

11 Claims, 6 Drawing Sheets

HAND-HELD FASTENER DRIVER

This claims priority to German Application Serial No. DE 10 2008 042 699.7, filed Oct. 9, 2008, the entire disclosure of which is hereby incorporated by reference herein.

The present invention relates to a hand-held fastener driver for fastening elements. Such hand-held fastener drivers have a movably arranged driving tappet by means of which fastening elements can be driven into a workpiece.

BACKGROUND OF THE INVENTION

These fastener drivers are powered, for instance, electrically, whereby at least one drive spring serves as the energy storage unit for the driving tappet, and this drive spring can be tensioned by means of an electrically operated tensioning mechanism. An advantage of such fastener drivers is their simple construction, which makes them inexpensive to produce.

A fastener driver configured as an electric nailer is disclosed in U.S. Pat. No. 3,810,572. This fastener driver has a driving hammer comprising a threaded shaft section that faces away from the driving direction and a hammer section that is positioned in the driving direction. Part of the threaded shaft section is arranged axially inside a drive spring element. A sleeve arranged radially on the outside around the non-rotatable driving hammer can be made to rotate by means of a drive motor, whereby balls that run in the sleeve engage with the thread of the threaded section in order to move the driving hammer axially against the drive spring element so as to tension the latter. For purposes of triggering a fastener driving procedure, a first latching sleeve is provided that is arranged so as to be movable on the outside of the sleeve and that can be moved axially by means of the trigger in order to release latching balls radially to the outside. Another latching sleeve that is arranged on the outside of the first latching sleeve controls the radial disengagement of the balls that engage with the thread. Once a fastener driving procedure has been triggered, the driving hammer, along with its hammer section and its shaft section, is moved in the driving direction by the drive spring element.

A drawback of this fastener driver is, on the one hand, that the construction of the three sleeves is very complex, thus making the fastener driver more expensive. On the other hand, when the fastener driver is triggered, the entire force of the drive spring is exerted for a brief moment onto a very small surface area at the edge of the thread where the last latching ball is disengaged. This entails the risk that the edge of the thread might break.

German patent application DE 32 37 087 A1 discloses a fastener driver configured as an electric tacker. With this fastener driver, a driving tappet configured as a firing pin is moved into a tensioned position against a drive spring by a rotating electric motor. For this purpose, the driving tappet is provided with teeth that can be made to engage with a threaded spindle that can be driven by an electric motor. In a tensioned end position of the drive spring, the threaded spindle swivels out of its engagement with the teeth on the driving tappet. In this tensioned position, the driving tappet can be locked by means of a locking member. In order to trigger a fastener driving procedure, a trigger switch such as a triggering lever or a pushbutton has to be actuated by means of which the locking member is released from its locked position on the driving tappet. The fastening elements that can be driven with the electric tacker can be stored, for example, in a cartridge.

A disadvantage of this fastener driver is that its construction with a controlled swiveling spindle is quite laborious and expensive. Moreover, a swiveling spindle is larger and heavier, which is a serious a drawback for a hand-held fastener driver.

SUMMARY OF THE INVENTION

Consequently, it is an objective of the present invention to create a fastener driver of the above-mentioned type that avoids the above-mentioned disadvantages and that has a simple construction.

The present invention provides a hand-held fastener driver for fastening elements, having a driving tappet that is movably mounted in a tappet guide and that can be driven by means of at least one drive spring element, having a tensioning means for the drive spring element, and having a locking mechanism in whose locked position the drive spring element can be locked in its tensioned position. According to it, guide means for the tensioning element can be provided that have a first guide section to non-rotatably guide the tensioning element along the longitudinal axis of motion and that have at least one additional guide section which allows the tensioning element to swivel around the longitudinal axis of motion, whereby the locking mechanism can be shifted into the release position by a swiveling movement of the tensioning element. Since, according to the invention, the function of the tensioning element is not only to tension but also to release the locking mechanism, there is no need for additional components in order to shift the locking mechanism into the release position, which greatly simplifies the construction or the design of the device. Moreover, the tensioning element can now be actuated via the motor of the locking mechanism, so that no additional auxiliary drive is needed.

Advantageously, a trigger switch can be provided by means of which the swiveling movement of the tensioning element can be initiated for shifting the locking mechanism into the release position, as a result of which a work procedure with the fastener driver can be carried out in the usual manner and additional switching elements can be dispensed with.

It is likewise advantageous for the additional guide section to have a stop that limits the swiveling of the tensioning element around the longitudinal axis of motion to a maximum swiveling angle within the range from 30° to 100°, which allows the use of a switch that can detect when the end position of the tensioning element has been reached. Furthermore, the swiveling movement during the tensioning procedure at a defined angle of 30° to 100° simultaneously also defines a swiveling angle by which the tensioning element is swiveled in the opposite direction, said angle being sufficient to bring about the shifting of the locking mechanism into the release position during the triggering procedure of the fastener driver. The stop also achieves that the tensioning element always remains in a defined rotational position, so that the swiveling angle needed for the triggering is precisely defined as well. As a result, the triggering procedure can be controlled in a simple and reliable manner.

In an embodiment with a favorable design, the tensioning element has at least one radially protruding guide element that interacts with the guide sections. Advantageously, precisely two guide elements are provided that are radially opposite from each other and that are fitted with guide rollers, so that the tensioning element is optimally guided. The guide rollers also serve to reduce the friction during the triggering procedure. Moreover, thanks to the two guide elements that are radially opposite from each other, the tractive forces are distributed uniformly and symmetrically, which reduces the occurring loads. As a consequence, the components can be dimensioned smaller.

Advantageously, a coupling and locking member of the locking mechanism is arranged on the first end of the tensioning element and this member can be made to engage with a counter-coupling part of the driving tappet. Moreover, the at least one guide element is provided on the second end of the tensioning element. This accounts for good space utilization that allows the fastener driver to be smaller in size.

It is likewise advantageous for a freewheel that can be activated via the trigger switch to be provided between the coupling and locking part and the locking element, as a result of which it can be achieved that not every swiveling movement in the activation direction of the locking mechanism leads to an activation and thus to a shift of the locking mechanism into the release position. For instance, the tension of the drive spring element can also be relaxed when the driving tappet is still coupled to the tensioning element in that the tensioning element is slowly moved back to its initial position (for example, when the fastener driver—with its drive spring in the tensioned state—has not been triggered for a long period of time).

In a variant that is easy to realize technically, the freewheel is advantageously configured as a wrap spring clutch.

In an embodiment that is easy to manufacture and technically reliable, the tensioning element is configured as a round rod provided with a profile in the form of a thread, said rod passing through the rotatably mounted counter-element that is configured as a lock nut and provided with an internal thread that is complementary to the thread of the tensioning element.

A torque-free driving and tensioning system can be obtained when the tensioning element is arranged coaxially to the driving tappet. Advantageously, in addition or as an alternative thereto, the tensioning element can also be coaxially arranged with respect to the at least one drive spring element in order to keep the driving and tensioning system torque-free.

BRIEF DESCRIPTION OF THE DRAWINGS

The invention is presented in an embodiment depicted in the drawings without being limited thereto.

The following is shown.

DETAILED DESCRIPTION

Figure 1:
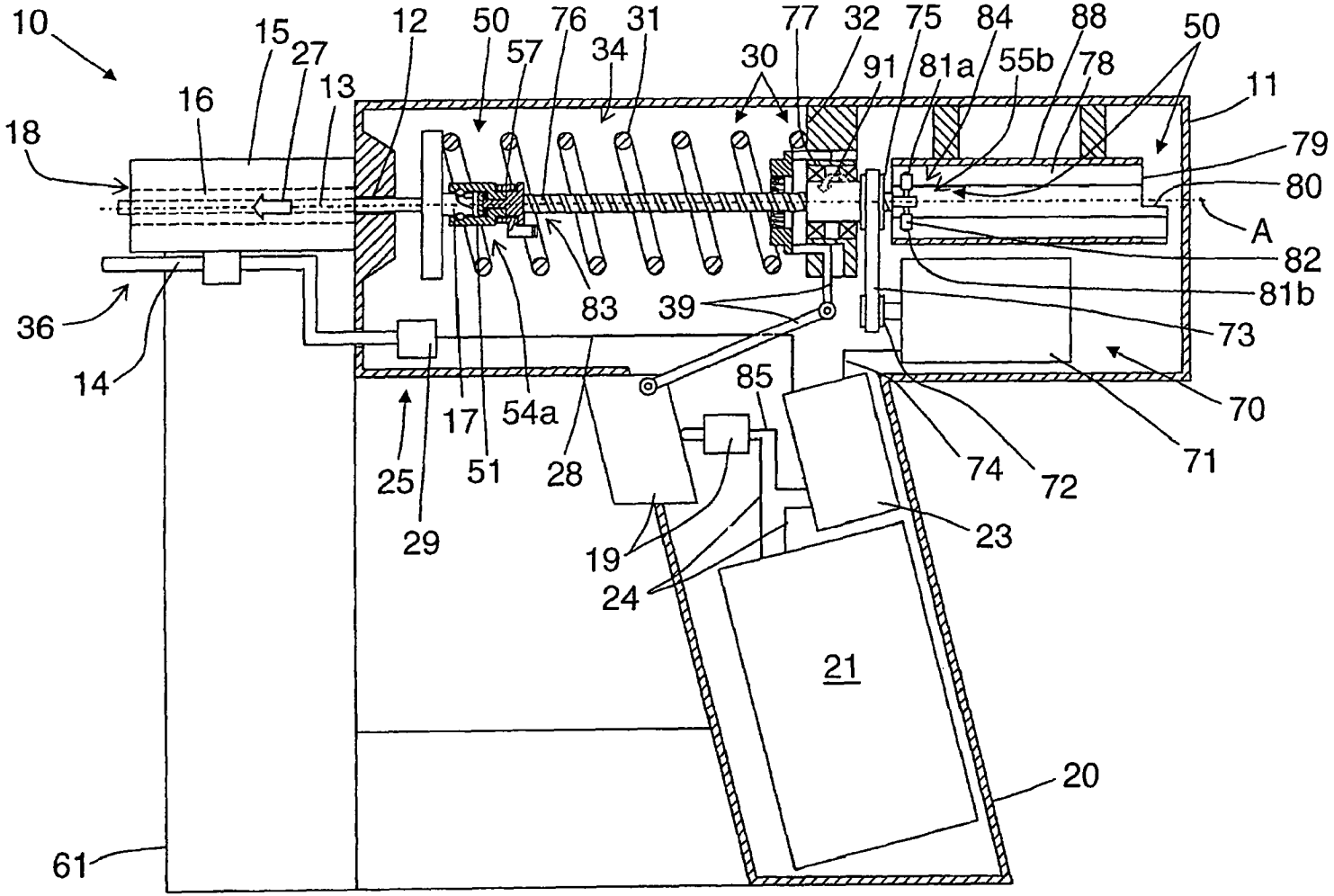
FIG. 1—a fastener driver according to the invention in the initial position.
Figure 2:
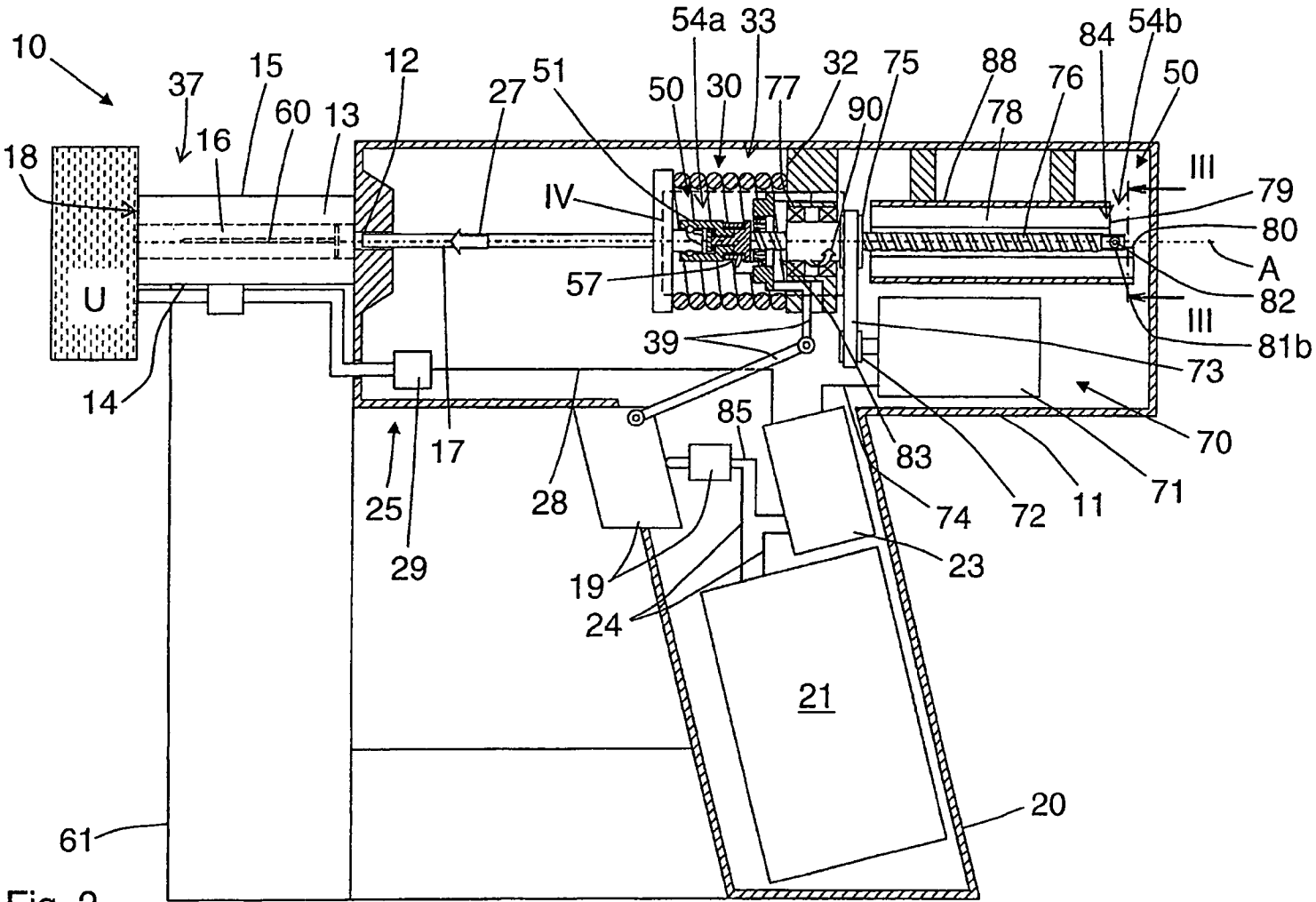
FIG. 2—the fastener driver from FIG. 1 in a position where it is ready to drive in a fastener.
Figure 6:
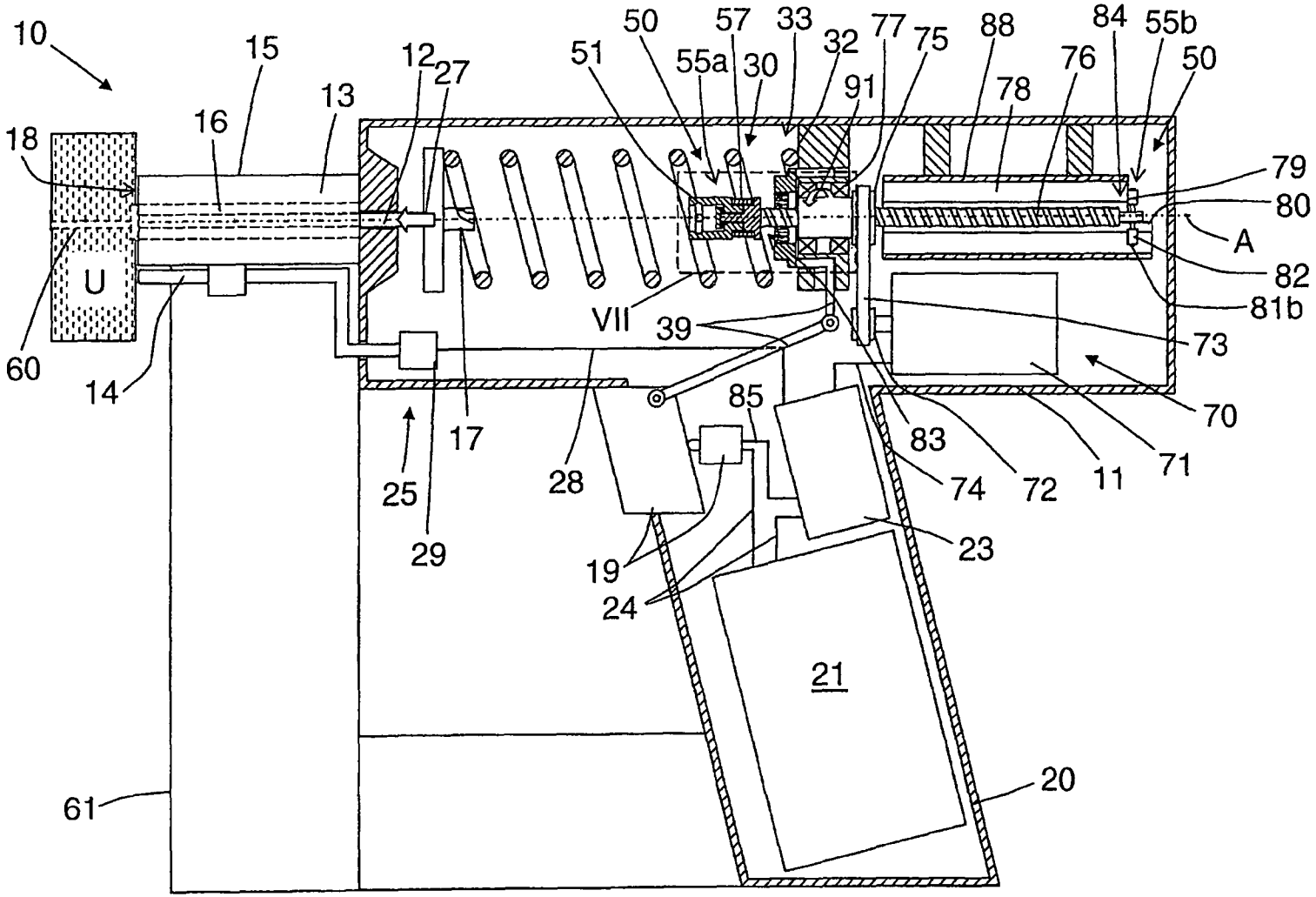
FIG. 6—the fastener driver from FIG. 1 after a fastener driving procedure has been triggered.

The hand-held fastener driver 10 depicted in FIGS. 1 to 8 is powered electrically and has a housing 11 and a drive arrangement situated therein and designated in its entirety by the reference numeral 30, said drive arrangement powering a driving tappet 13 that can be moved in a guide 12 (see, in particular, FIGS. 1, 2 and 6). The drive arrangement 30 also comprises a drive spring element 31, one end of which rests on a support point 32 on the housing 11, while the other end engages with the driving tappet 13. Instead of only one drive spring element, there could also be, for instance, two drive spring elements as described, for example, in German patent application DE 10 2007 000 226 A1. There, the two drive spring elements are coupled to each other via a gear mechanism that is coupled to the driving tappet on the driven side. The gear mechanism can have a gear ratio of, for example, about 1:4 between the input movement and the output movement of the drive spring elements, which can make the stroke of the driving tappet four times longer at a given expansion distance of the drive spring elements.

The end of the guide 12 that is positioned in the driving direction 27 is followed by an mouthpiece 15 having a driving channel 16 that runs coaxially to the guide 12 and that holds the fastening elements 60. Protruding laterally from the mouthpiece 15, there is a fastening element cartridge 61 where the fastening elements 60 can be stored.

The fastener driver 10 also has a handle 20 on which a trigger switch 19 is arranged for triggering a fastener driving procedure with the fastener driver 10. A power supply unit, designated in its entirety by the reference numeral 21, is also arranged on the handle 20 and it serves to provide the fastener driver 10 with electric power. Here, the power supply 21 comprises at least one battery. The power supply unit 21 is connected via electric supply lines 24 to an electric control unit 23 as well as to the trigger switch 19. The trigger switch 19 is also connected to the control unit 23 via a switch line 85.

A contact element 14 configured as a contact sensor of a safety means 25 is arranged on the mouthpiece 15 of the fastener driver 10 and it can be used to actuate an electric contact switch 29 of the safety means 25, said contact switch being electrically connected to the control unit 23 via a switching element line 28. The electric contact switch 29 sends an electric signal to the control unit 23 as soon as an opening 18 of the mouthpiece 15 of the fastener driver 10 is pressed against a workpiece U, as can be seen in FIG. 2, thus ensuring that the fastener driver 10 can only be triggered when it has been properly pressed against a workpiece U. For this purpose, the contact element 14 can be moved along a longitudinal axis of motion A defined by the driving channel 16 or by the trajectory of motion of the driving tappet 14, and it can be moved between an initial position 36 (see FIG. 1) and a contact position 37 (see FIGS. 2 and 6). The contact element 14 is elastically pushed towards its initial position by means of a spring element (not visible in the figures).

The fastener driver 10 also has a tensioning means (designated in its entirety by the reference numeral 70) for the drive spring element 31. This tensioning means 70 comprises an electrically powered motor 71 with which an axially movable tensioning element 76 can be axially moved by means of a counter-element 75 that is rotationally mounted. In this context, the tensioning element 76 is configured, for example, as a round rod provided with a profile in the form of an external thread. The counter-element 75 is rotatably mounted on at least one bearing 77 and is configured, for instance, as a lock nut that is provided with an internal thread that is complementary to the thread of the tensioning element 76 and engages with it. The motor 71 is electrically connected to the control unit 23 via a second control line 74 and can be put into operation by means of said control unit, for example, when, during a contact procedure, the contact switch 29 is activated via the contact element 14 or already after the fastener driving procedure has been carried out, when the fastener driver 10 is once again lifted off of the workpiece U. In this process, the motor 71 is configured in such a way that it can be driven in both possible rotational directions. A driven gear 72 rests on a driven shaft of the motor 71 and it can be made to rotate together with the counter-element 75 via a transmission element 73 in order to impart the counter-element 75 with a rotational movement during the operation of the motor 71. The transmission element 73 here is configured, for instance, as a belt, timing belt, chain, cardan shaft, push rod or gear wheel. The axis of the driven shaft of the motor 71 is arranged parallel to the rotational axis of the counter-element 75 and parallel to the longitudinal axis of motion A.

In the area of the housing 11 facing away from mouthpiece 15, there are guide means for the tensioning element 76 that have a first guide section 78 to non-rotatably guide the tensioning element 76 along the longitudinal axis of motion A and that have at least one guide section 79 which allows the tensioning element 76 to swivel around the longitudinal axis of motion A. The guide sections 78, 79 are arranged, for example, on a housing-fixed guide sleeve 88 for the tensioning element 76, whereby the guide section 78 runs axially and parallel to the longitudinal axis of motion A, while the other guide section 79 is arranged on the face of the guide sleeve and is oriented crosswise to the longitudinal axis of motion A—in other words, in the circumferential direction with respect to the longitudinal axis of motion A or to the tensioning element 76. On the other guide section 79, there is at least one stop 80 that restricts the swiveling of the tensioning element 76 around the longitudinal axis of motion A to a maximum swiveling angle within the range from 30° to 100°, preferably 90°. On an axial first end 83 facing the mouthpiece 15, the tensioning element 76 has a coupling and locking part 51 of a locking mechanism that is designated in its entirety by the reference numeral 50 and that can be made to engage with a counter-coupling part 17 of the driving tappet 13. In FIGS. 1, 2, 4 and 7, the coupling and locking part 51 is depicted in its coupled position 54*a*, in which it is engaged with the counter-coupling part 17. The coupling and locking part 51 has a receptacle 53 into which the coupling bodies 52 configured as balls protrude. When these coupling bodies 52 are coupled, they move along guide paths 22 on the counter-coupling part 17, where they can latch in the manner of a bayonet lock (see, in particular, FIGS. 4 and 7). The axial second end 84 of the tensioning element 76 has at least one—in the embodiment shown exactly two—guide elements 81*a*, 81*b* that protrude laterally or radially from the tensioning element 76 and that, in the position of the tensioning element 76 shown in FIG. 1, are in the guide section 76. The guide elements 81*a*, 81*b* each support guide rollers 82 that can roll on the guide surfaces of the guide sections 78, 79.

The guide elements 81*a*, 81*b* and the additional guide section 79, along with the coupling and locking part 51 and the counter-coupling part 17, are functionally associated with the locking mechanism 50. In an axial locked position 54*b*, which can be seen in FIGS. 2 and 3, the guide elements 81*a*, 81*b* lie against the stop 80 on the additional guide section 79, thus preventing the tensioning element from moving back in the firing direction 27 under the effect of the drive spring 31. If the coupling and locking part 51 as well as the counter-coupling part 17 are in the coupled position 54*a* and the guide elements 81*a*, 81*b* lie against the stop 80 on the additional guide section 79 in its axial locked position 54*b*, then the locking mechanism 50 is in its locked position, as can be seen in FIG. 2, in which the driving tappet 13 is held in the position where it is ready to drive in the fastener (see FIG. 2).

Figure 4:
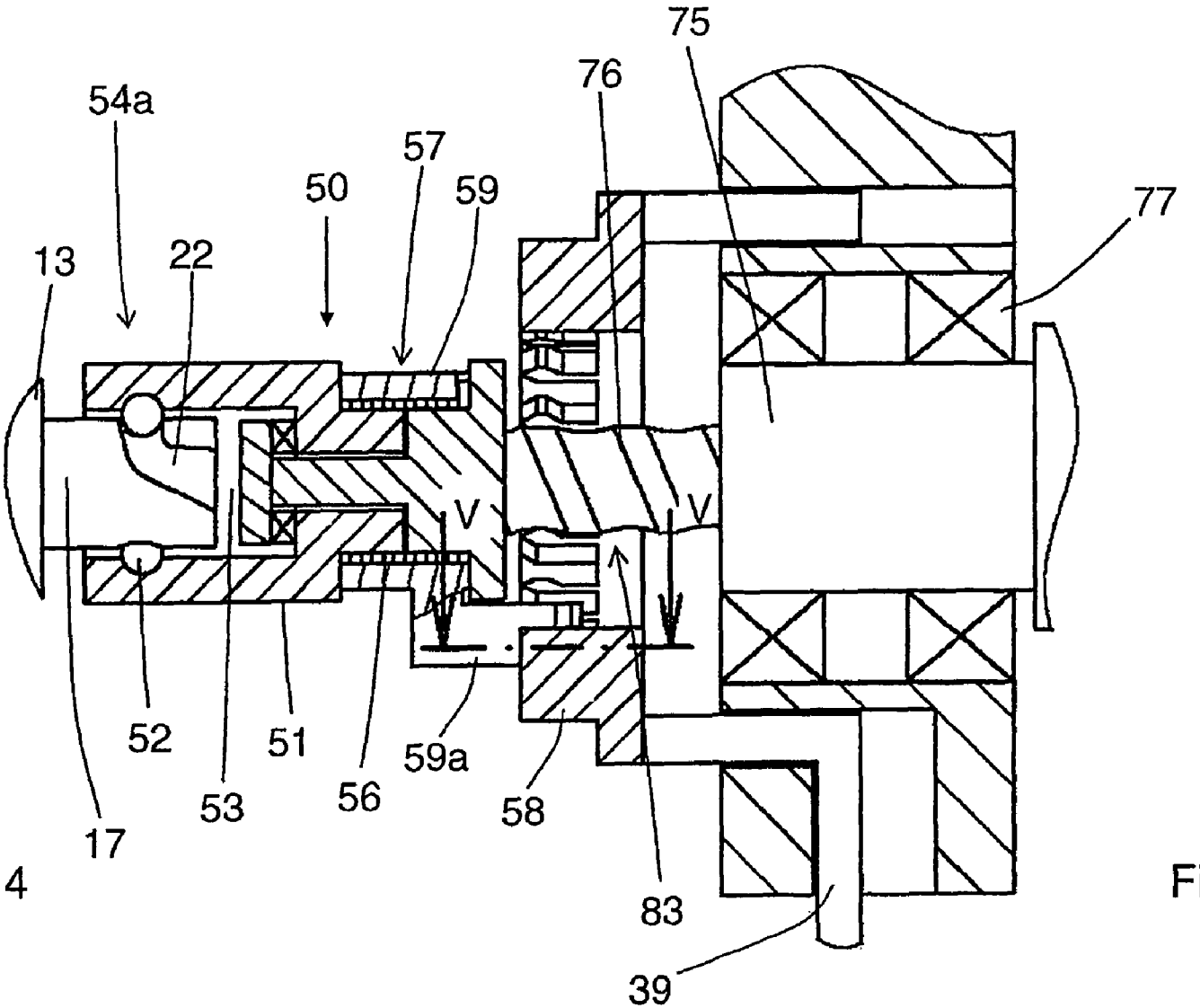
FIG. 4—a detail of the fastener driver according to the marking IV from FIG. 2.
Figure 7:
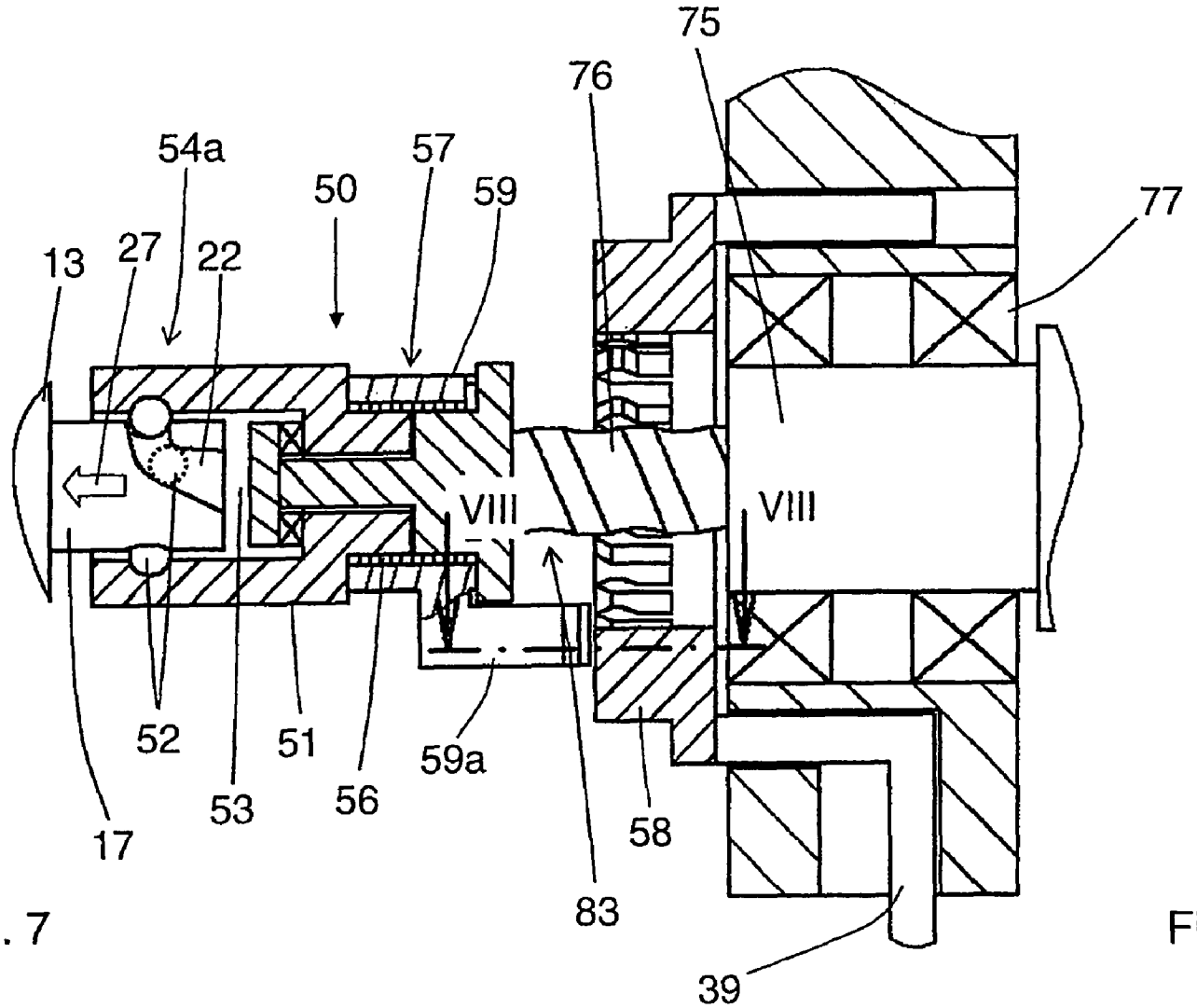
FIG. 7—a detail of the fastener driver according to the marking VII from FIG. 6.

As shown in detail in FIGS. 4 and 7, between the coupling and locking part 51 and the tensioning element 76, there is a freewheel 57 configured as a wrap spring clutch. The freewheel 57 has an axially movable switching element 58 configured as a ratchet ring, a ratchet sleeve 59 with a ratchet plate 59*a* and a wrap spring 56 that is arranged inside the ratchet sleeve 59 and that wraps around one end of the coupling and locking part 51 as well as around one end of the tensioning element 76. Ratchet teeth 58*a* are arranged at regular intervals on the inner circumference of the switching element 58, whereby the ratchet plate 59*a* can engage with the tooth interstices of said ratchet teeth 58*a* (see FIGS. 5 and 8). The switching element 58 is coupled by means of a switching line 39 to the trigger switch 19 with which said switching element can be actuated, as will be elaborated upon below.

Figure 3:
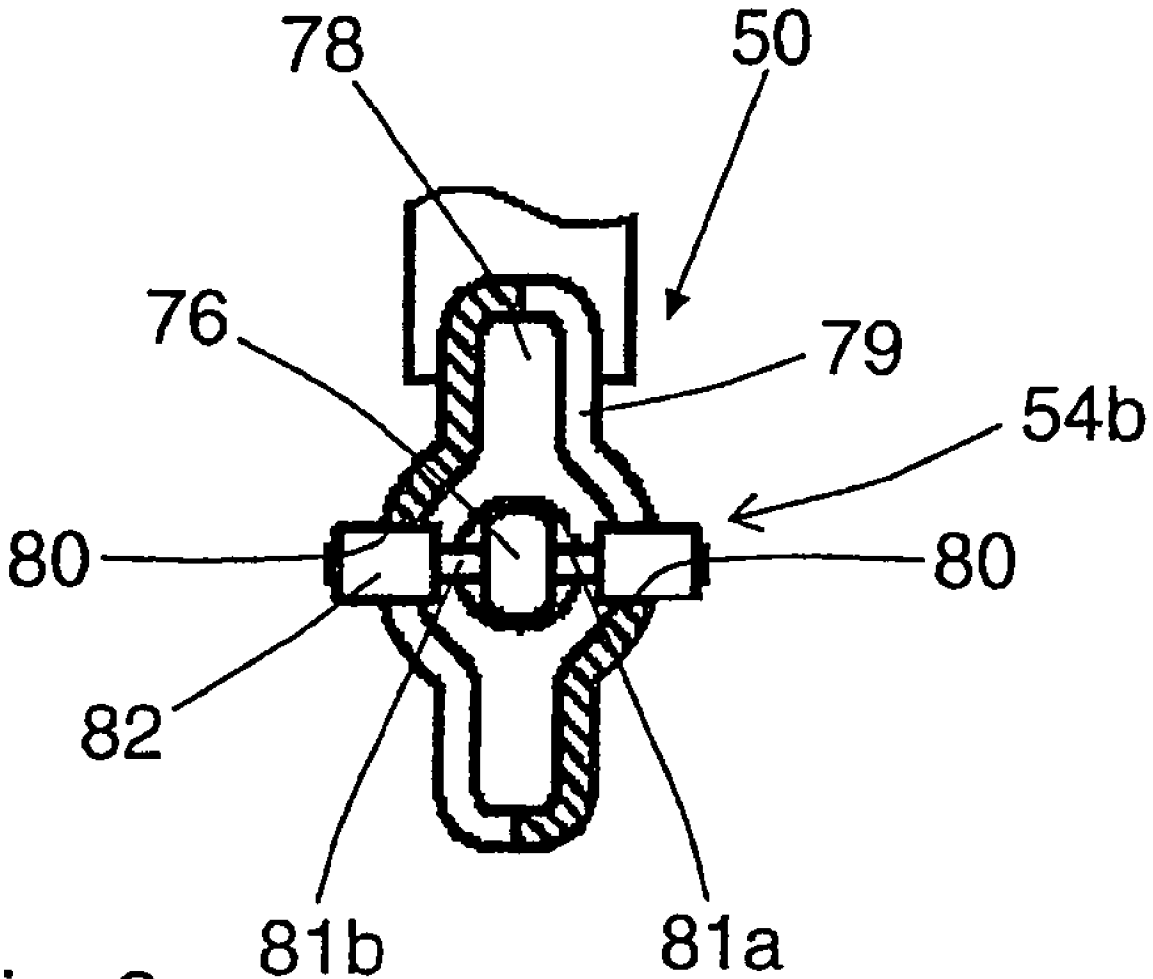
FIG. 3—a section through line III-III from FIG. 2.
Figure 5:
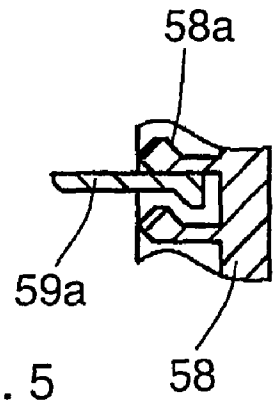
FIG. 5—a section along line V-V from FIG. 4.

FIG. 1 shows the fastener driver 10 in its initial position, in which the drive spring element 31 is in its non-tensioned position 34. The tensioning element 76 is coupled to the coupling and locking part 51, and the counter-coupling part 17 is coupled to the driving tappet. If the opening 18 of the fastener driver 10 is pressed against a workpiece U, as can be seen in FIG. 2, then the control unit 23 is made ready for firing by means of the contact element 14 and the electric contact switch 29, and a switching command is sent to the motor 71, which causes the counter-element 75 to rotate in the rotational direction indicated by the first arrow 90 via the driven wheel 72 and the transmission element 73. Owing to the rotation of the counter-element 75, the tensioning element 76—which is non-rotatably held in the first guide section 78 of the guide sleeve 88 by means of the guide elements 81*a*, 81*b*—is axially moved opposite to the driving direction 27. Once the tensioning element 76 with its guide elements 81*a*, 81*b* has left the first guide section 78 and has reached the additional guide section 79, the rotation of the counter-element 17 causes the tensioning element 76 to swivel or turn by an angle of 90° in the rotational direction indicated by the first arrow 90 until the guide elements 81*a*, 81*b* strike the stops 80, as shown in FIGS. 2 and 3. When the guide elements 81*a*, 81*b* strike the stops 80, a switch (not shown in the figures) switches off the motor 71 via the control unit 23. The drive spring element 31 is now in its tensioned position 33, in which the fastener driver 10 is ready for a fastener driving procedure.

During the rotational movement of the counter-element 75, the coupling and locking part 51 was rotationally uncoupled from the tensioning element 76 by the freewheel 57, so that the coupling and locking part 51 did not completely execute the 90° swiveling movement of the tensioning element 76 since the freewheel 57 does not transmit any torque in this rotational direction.

The freewheel 57 is configured so that it can be switched, that is to say, it can be turned off via the switching element 58. Thanks to the fact that the freewheel can be switched, the drive spring element 31 can also be switched from its tensioned position 33 into its non-tensioned position 34 by means of an tension-relaxing function of the fastener driver 10 without actuating the trigger switch 19 in that, for example, in case of a prolonged interruption in operation, the control unit 23 switches the motor 71 in an opposite rotational movement, thus rotating the counter-element 75 in the direction indicated by the second arrow 91 (see FIG. 1), as a result of which the tensioning element 76 is swiveled back by 90° and the guide elements 81*a*, 81*b* once again move into the first guide section 78. Then, as the tension of the drive spring 31 is relaxed, the tensioning element 76 is then moved in the firing direction 27 without a fastener driving procedure being triggered.

FIG. 4 depicts the freewheel 57 in its switched-off position, in which the freewheel 57 does not transfer any torque in either of the two possible directions of rotation.

Figure 8:
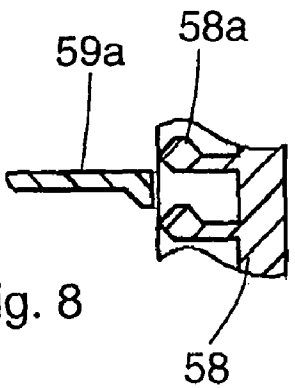
FIG. 8—a section along line VIII-VIII from FIG. 7.

In FIG. 6, the trigger switch 19 has been activated, as a result of which the switching line 39 moved the switching element 58 axially opposite to the firing direction 27 and the ratchet plate 59*a* released the ratchet sleeve 59 of the freewheel 57 (see FIGS. 7 and 8). The freewheel 57 was thus switched on, so that it can transfer a torque of the tensioning element 76 to the coupling and locking part 51 in the rotational direction indicated by the arrow 91.

Moreover, an electric switching signal was transmitted via the trigger switch 19 to the control unit 23, which then switched the motor 71 in an opposite rotational movement that rotated the counter-element 75 in the direction indicated by the second arrow 91 (see FIG. 6). As a result, the tensioning element 76 was swiveled back again by 90° and the guide elements 81*a*, 81*b* were once again able to move into the first guide section 78 and were shifted into the unlocked position 55*b*, as can be seen in FIG. 6. Owing to the fact that the freewheel 57 was switched, this 90° rotation was now also completely executed by the coupling and locking part 51, as a result of which the coupling body 52 (see FIG. 7) was able to move out of the guide paths 22. The coupling and locking part 51 was thus shifted into its release position 55*a* in which it is uncoupled from the counter-coupling part 17. The driving tappet 13 was subsequently moved into the firing position 27 via the drive spring element 31, whose tension is relaxing, in order to drive a fastening element 60 into the workpiece U.

Therefore, the swiveling movement of the tensioning element 76 shifted the locking mechanism 50 into the release position in that the coupling and locking part 51 was shifted into its release position 55*a* and the guide elements 81*a*, 81*b* were shifted into their unlocked position 55*b*.

Once the trigger switch 19 has been actuated, the tensioning element 76 is moved in the firing direction 27 until the coupling and locking part 51 once again becomes coupled to the counter-coupling part 17. The tensioning element 76 then once again assumes the position shown in FIG. 1, in which the pressure of the fastener driver 10 against a workpiece U can cause the drive spring element 31 to tension once again, as has been already described above.

What is claimed is:

1. A hand-held fastener driver for fastening elements comprising:

a driving tappet movably mounted in a tappet guide and driveable by at least one drive spring element;

a tensioner for the drive spring element;

a locking mechanism having a locked position where the drive spring element is lockable in a tensioned position; and the tensioner having a tensioning element provided with a profile, the tensioning element axially moveable along a longitudinal axis of motion by a rotatable counter-element engaged with the profile and driveable by a motor;

a guide for the tensioning element having a first guide section to non-rotatably guide the tensioning element along the longitudinal axis of motion and at least one additional guide section allowing the tensioning element to swivel around the longitudinal axis of motion, the locking mechanism shiftable into a release position by a swiveling movement of the tensioning element.

2. The fastener driver according to claim 1, further comprising a trigger switch, the swiveling movement of the tensioning element capable of being initiated via the trigger switch to shift the locking mechanism into the release position.

3. The fastener driver according to claim 2, further comprising a freewheel switchable by the trigger switch and arranged between a coupling and locking part of the locking mechanism and the tensioning element.

4. The fastener driver according to claim 3, wherein the freewheel is configured as a wrap spring clutch.

5. The fastener driver according to claim 1, wherein the additional guide section has a stop limiting the swiveling of the tensioning element around the longitudinal axis of motion to a maximum swiveling angle within a range from 30° to 100°.

6. The fastener driver according to claim 1, wherein the tensioning element has at least one radially protruding guide element interacting with the guide sections.

7. The fastener driver according to claim 1, further comprising two guide elements radially opposite from each other and having guide rollers.

8. The fastener driver according to claim 1, wherein a first end of the tensioning element has a coupling and locking part of the locking mechanism, the coupling and locking part engageable with a counter-coupling part of the driving tappet, and a second end of the tensioning element has at least one guide element.

9. The fastener driver according to claim 1, wherein the tensioning element is configured as a round rod provided with the profile in the form of a thread, said rod passing through a rotatably mounted counter-element configured as a lock nut and provided with an internal thread complementary to the thread of the tensioning element.

10. The fastener driver according to claim 1, wherein the tensioning element is arranged coaxially to the driving tappet.

11. The fastener driver according claim 1, wherein the tensioning element is arranged coaxially to the at least one drive spring element.

* * * * *